US005529556A

United States Patent [19]

Segarra

[11] Patent Number: 5,529,556

[45] Date of Patent: Jun. 25, 1996

[54] JOGGING AND WALKING EXERCISE DEVICE AND METHOD OF USE THEREOF

[76] Inventor: Anthony Segarra, 54 Blue Spruce Rd., Levittown, N.Y. 11756

[21] Appl. No.: 193,379

[22] Filed: Jan. 31, 1994

[51] Int. Cl.[6] ..... A63B 22/00

[52] U.S. Cl. ..... 482/74; 224/259

[58] Field of Search ..... 482/74; 224/202, 224/209, 257–259

[56] References Cited

U.S. PATENT DOCUMENTS

| | | | |
|---|---|---|---|
| 1,178,628 | 4/1916 | Clawson | 224/259 |
| 2,441,115 | 5/1948 | Lambert | 229/259 |
| 4,320,863 | 3/1982 | Lyer et al. | 229/259 |
| 4,335,875 | 6/1982 | Elkin | 482/74 |
| 4,337,938 | 7/1982 | Rodriguez | 482/74 |
| 5,167,598 | 12/1992 | Sands | 482/74 |

FOREIGN PATENT DOCUMENTS

| | | | |
|---|---|---|---|
| 166788 | 8/1953 | Australia | 229/259 |

*Primary Examiner*—Richard J. Apley
*Assistant Examiner*—John Mulcahy

[57] ABSTRACT

An upper torso arm weight support to be used during jogging and walking to obviate muscle fatigue in the rear shoulder and lower neck regions having the corresponding result of prolonging the exercise routine with attendant benefit to leg and/or further overall muscle or aerobic development. A medial portion of a cushioned non-elastic band is positioned intermediate the user's shoulders just below the user's neck by criss-crossing straps. The user grasps handgrips at either end of the band which thereby supports the weight of the arms.

1 Claim, 2 Drawing Sheets

JOGGING AND WALKING EXERCISE DEVICE AND METHOD OF USE THEREOF

The present invention relates to an upper torso harness-type device for use during jogging and walking, of which the primary function is to relieve fatigue rather than to contribute to muscle development, the latter typically being the objective of known devices, namely to develop upper torso muscles while the jogging and walking develops leg muscles.

EXAMPLES OF THE PRIOR ART

In U.S. Pat. No. 4,993,705 issued to Tolle on Feb. 19, 1991, it is proposed during use of a jogging vest that arm thrusts be made against the resistance of elastic straps attached to the vest "for training the muscles of the upper body".

The exercising of upper torso muscles during leg exercising by jogging and walking is also the thrust of U.S. Pat. No. 4,961,573 issued to Wehrell on Oct. 9, 1990 and U.S. Pat. No. 4,911,439 issued to Kuhl on Mar. 27, 1990, to mention exemplary patents that have this common objective.

The within inventive harness-type upper torso jogging and/or walking device has the radically different objective of obviating fatigue during the jogging or walking exercise routine and, in this respect, underlying the present invention is the recognition that in obviating fatigue the jogging and walking can be correspondingly prolonged and thus achieve a more effective overall aerobic exercise.

Broadly, it is an object of the present invention to provide an improved upper torso harness-type device overcoming the foregoing and other fatigue-producing shortcomings of the prior art. More particularly, the specific object of the embodied improvements are to relieve the jogging or walking exerciser of his/her arm weight, which in rear shoulder and neck muscles obviates fatigue and contributes to prolonging the exercise routine, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Underlying the present invention is the recognition that, as much as distance and pace, arm weight of an exercising jogger or walker contributes significantly to fatigue, particularly in the muscles located centrally of the shoulders and just below the neck, i.e. the trapezius or trapezoid, as well as in the connecting muscles of the upper back, i.e. latissimus dorsi and tres major, and in other locations of which the aforementioned are illustrative and the mentioning thereof suffices for understanding the objective of the present invention. That objective is primarily to relieve the user of his/her arm weight, and also to in other ways contribute favorably to the jogging and walking exercise routine, as will be better understood as the description proceeds.

Figure 1:
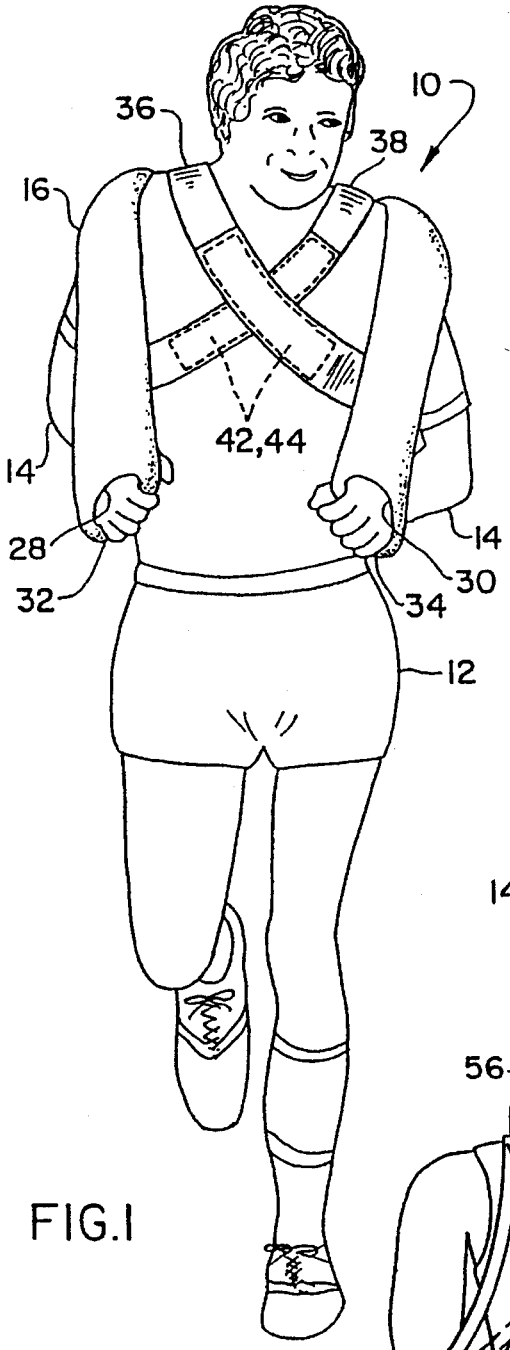
FIG. 1 is a front elevational view illustrating a contemplated use of the within inventive exercise device during jogging.
Figure 2:
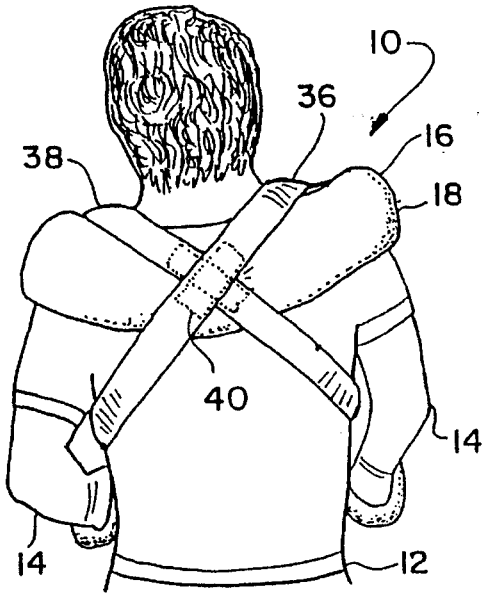
FIG. 2 is a partial rear view projected from FIG. 1.

Reference should be made to FIGS. 1 and 2 respectively illustrating in front and rear perspectives the within exercise device, generally designated 10 in a contemplated end use during jogging by a male (or female) user 12 which allows support of his arms 14 in a condition bent approximately 90 degrees at the elbow, while permitting, as should be readily appreciated from FIGS. 1 and 2, the alternate swinging of each bent supported arm 14 in relation to left and right jogging strides.

Figures 3, 4, 5:
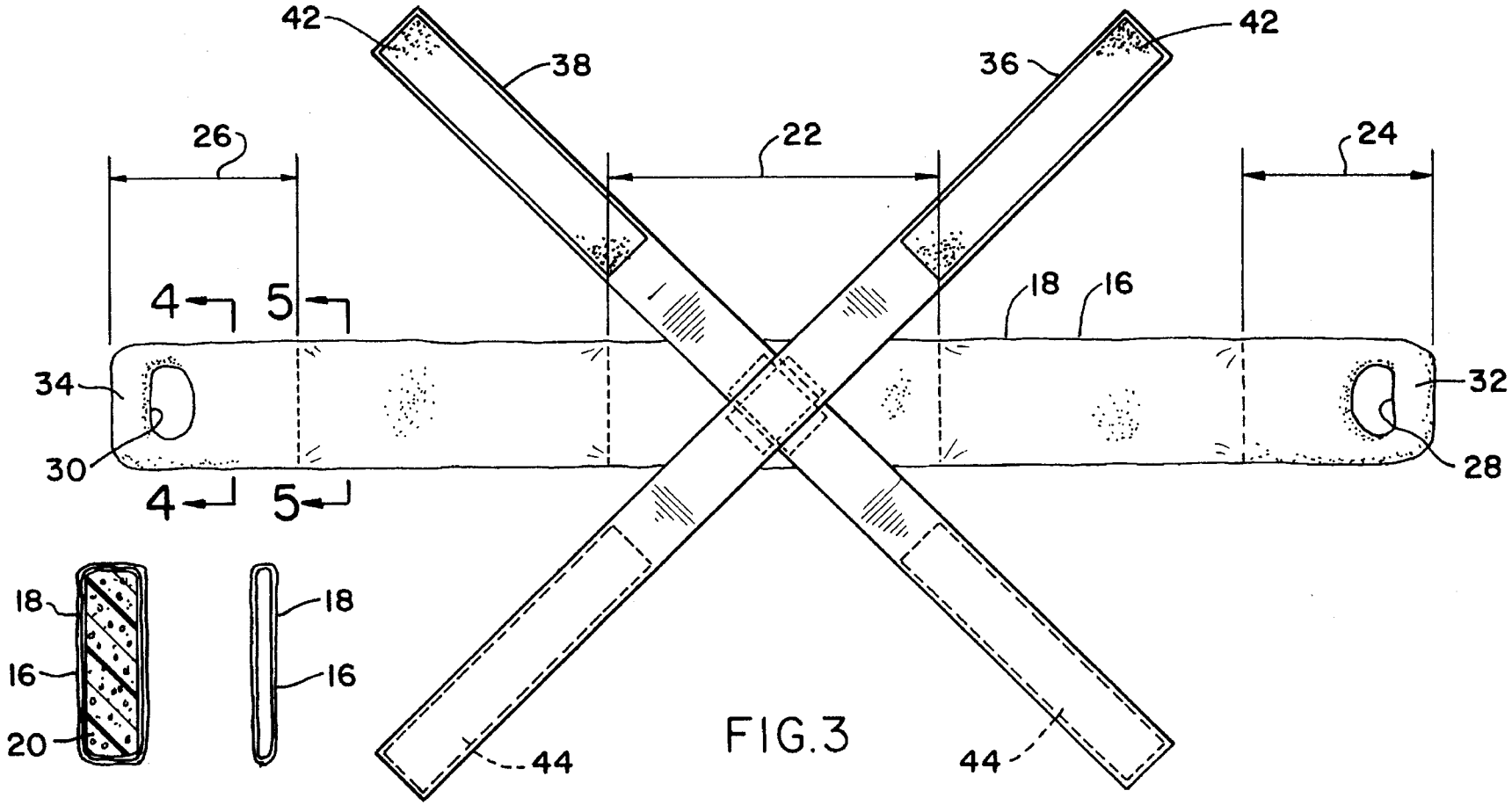
FIG. 3 is an isolated plan view of the exercise device.
FIG. 4 is a sectional view taken along line 4—4 of FIG. 3.
FIG. 5 is similarly a sectional view, but taken along line 5—5 of FIG. 3.

As may be best understood from FIGS. 3–5 in conjunction with FIGS. 1 and 2, the construction of what aptly may be termed a shoulder harness form of exercise device 10 includes an elongated padded tubular body 16 preferably 6 inches wide and of washable terry cloth 18 disposed about foam plastic or polyester fibrous mass 20 (see FIG. 4) which, to reduce weight and cost, might optionally be restricted to a medial length portion 22, but may also embody end length portions 24 and 26. Openings 28, 30 bound hand grip 32, 34 and, most significantly, the selected length of the body 16 is sized in relation to the prospective user to contribute to the bent 90 degree arm configuration when the hand grips 32, 34 are used. Stated otherwise, the length portions of the tubular body 16 which extend left and right beyond the user's shoulders, as viewed in FIG. 1, define in conjunction with the user's bent arms 14 a triangular configuration which alternately partakes of or undergoes pivotal traverses during the exercising routine.

For proper positioning of the device 10, as shown in FIGS. 1 and 2, the assumed in-use position of the medial length portion of the tubular body 16 is of a horizontal orientation lengthwise of the rear shoulder area just below the neck (FIG. 2), and this position is achieved using criss-crossed straps 36 and 38 sewn at 40 to the tube 16 and formed into closed loops about the shoulders of the user using cooperating velcro tabs 42 and 44, each closed loop being threaded over a cooperating shoulder and under an armpit.

Figure 6:
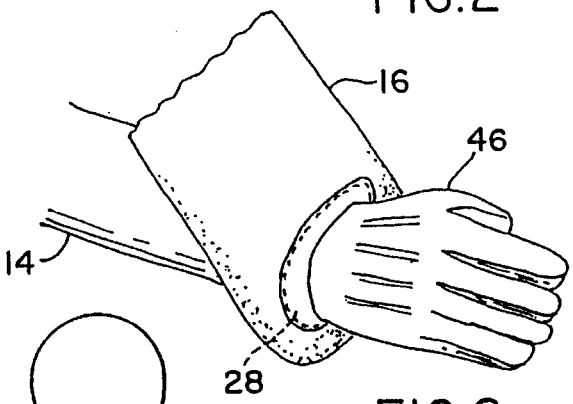
FIG. 6 is a partial perspective view illustrating another embodiment differing from that of FIGS. 1–3 of a hand grip of the exercise device.

In FIG. 6, as an alternate to the hand grips 32, 34 of FIGS. 1–5, use is made of a glove 46 (only one shown) for the user's hands.

Figure 7:
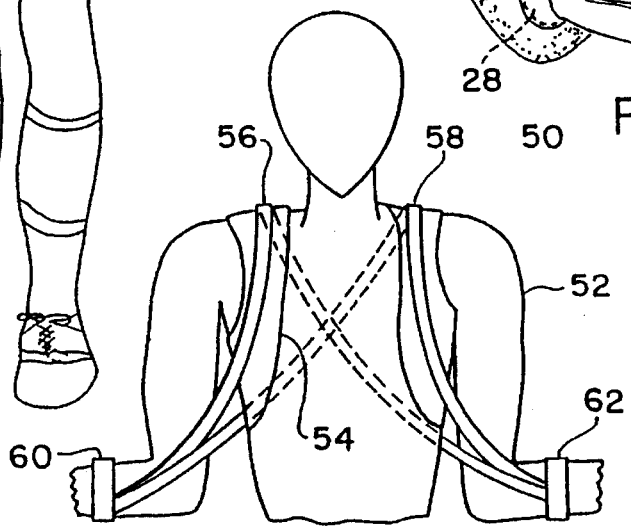
FIG.7 PRIOR ART
FIG. 7 is a simplified front view of a prior art exercise device provided for comparison in understanding the patentable advance of the within inventive exercise device.

What has been described achieves the objective of obviating arm-weight fatigue, and is to be distinguished from the FIG. 7 prior art device 50 of U.S. Pat. No. 4,993,705 issued to Tolle on Feb. 19, 1991, in the use of which there is provided a vest 54 and two straps 56 and 58 of elastic construction material with end wrist cuffs 60 and 62. The structural differences are not as significant as the method of use differences since the straps 56 and 58, being constituted of elastic, do not support arm weight, but function as a force resistance against which the user makes exercising arm movements.

While the exercise device for practicing the within inventive method, as well as said method herein shown and disclosed in detail, is fully capable of attaining the objects and providing the advantages hereinbefore stated, it is to be understood that it is merely illustrative of the presently preferred embodiment of the invention, and that no limitations are intended to the detail of construction or design herein shown other than as defined in the appended claims.

What is claimed is:

1. A method of minimizing fatigue due to arm weight during jogging and walking using a cushioned non-elastic band of approximately 6 inches width and a selected length having hand grips at opposite ends thereof, said method comprising the steps of preliminarily positioning a medial length portion of said band rearwardly in spanning relation along the user's shoulder to delineate two opposite length portions in said band extending beyond each shoulder to each said hand grip to serve as arm supports, attaching criss-crossing straps in a rearward location of said band intermediate of opposite sides of said shoulder of said user, attaching to establish said preliminary positioning of said band into a maintained exercise position said criss-crossing straps to each other extending from said band rearward location in closed loops about said user's arms to contribute to obviating slippage of said band from said spanning relation thereof along the user's shoulder, bending at each elbow to subtend an exercising angle of ninety degrees in each said user's forearm and upper arm, and gripping said band hand grips with said arms in said exercising angle to form a triangular configuration during jogging and walking, whereby neck muscles are relieved of supporting arm weight to contribute to minimizing fatigue of said muscles.

* * * * *